US006236250B1

(12) United States Patent
Salmon et al.

(10) Patent No.: US 6,236,250 B1
(45) Date of Patent: May 22, 2001

(54) CIRCUIT FOR INDEPENDENT POWER-UP SEQUENCING OF A MULTI-VOLTAGE CHIP

(75) Inventors: Joseph H. Salmon, Placerville; Navneet Dour, Fair Oaks, both of CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/436,672

(22) Filed: Nov. 10, 1999

(51) Int. Cl.[7] ..... G05F 1/10
(52) U.S. Cl. ..... 327/143; 327/538
(58) Field of Search ..... 327/142, 143, 327/198, 530, 538

(56) References Cited

U.S. PATENT DOCUMENTS

| | | | | |
|---|---|---|---|---|
| 5,440,244 | | 8/1995 | Richter et al. | 326/37 |
| 5,442,312 | * | 8/1995 | Walter | 327/143 |
| 5,625,280 | | 4/1997 | Voldman | 323/284 |
| 5,703,510 | * | 12/1997 | Iketani et al. | 327/143 |
| 5,862,390 | | 1/1999 | Ranjan | 395/750.01 |
| 5,864,247 | * | 1/1999 | Hirano et al. | 327/143 |
| 5,920,089 | | 7/1999 | Kanazawa et al. | 257/202 |

* cited by examiner

*Primary Examiner*—Jung Ho Kim
(74) *Attorney, Agent, or Firm*—Blakely, Sokoloff, Taylor & Zafman LLP

(57) ABSTRACT

A power-up circuit for a multi-voltage chip having two or more electrostatic devices coupled in series between first and second power supply lines, with a first electrostatic device being coupled between a node and the second power supply line. The power-up circuit comprising a MOS transistor coupled between the first power supply line and the node. A voltage divider coupled between the first and second power supply lines controls the conductivity of the MOS transistor. An internal node of the voltage divider is coupled to the gate of the MOS transistor and the divider is configured such that the internal node rises in potential following power-up to regulate the conductivity of the MOS transistor. The MOS transistor changes from a high conducting state to a low conducting state responsive to an increase in potential of the second power supply line following power-up.

14 Claims, 1 Drawing Sheet

CIRCUIT FOR INDEPENDENT POWER-UP SEQUENCING OF A MULTI-VOLTAGE CHIP

FIELD OF THE INVENTION

The present invention relates to the field of integrated circuits (ICs); more particularly, to circuits and methods useful for reliable power-up sequencing of supply lines that provide power to an IC.

BACKGROUND OF THE INVENTION

Many types of integrated circuits are manufactured to include logic that operates at different voltage power supply levels. For example, a modern microprocessor chip may include core logic operating at a power supply voltage of 2.5 volts, which interfaces with input/output (I/O) circuitry operating in a 3.3 volt DC power supply. By way of further example, many floppy disk and hard disk controller integrated circuits interface with ISA or EISA busses that require a 5.0 volt power supply. In other instances, many PCMCIA circuit cards are manufactured to operate at 3.3 volts or 5.0 volts. Examples of prior art methods for interfacing components of mixed DC supply voltages are described in U.S. Pat. No. 5,440,244.

Devices that operate with multi-level voltage power supplies typically require a power-up sequence for proper initialization. Since the core logic may operate at a lower voltage than the periphery or I/O circuitry, it is desirable if the core voltage ramps up first. By ramping the core logic voltage supply lines prior to the I/O voltage supply lines, the inputs to the voltage level shifting circuitry associated with the core logic can initialize properly. In cases where the I/O voltage supply lines ramp up first, the level shifters may allow excessive power to be drawn by the device—possibly causing the internal CMOS circuitry to enter a latch-up condition. This problem of drawing large amounts of current upon power-up in a mixed voltage, multi-rail integrated circuit is discussed in U.S. Pat. No. 5,862,390.

Another difficulty associated with multi-power supply integrated circuits is the presence of electrostatic discharge (ESD) devices, which are included to protect the chip from destructive static discharge events. To protect against ESD events, a number of diodes are usually coupled between the various power supply lines. For example, ESD networks comprising two or more series connected diodes are typically connected to the power rail $V_{CC}$ to provide proper protection and noise decoupling. During power-up sequencing, the ESD diodes may transfer power from an externally supplied rail voltage to an internal rail voltage. At power-up, power may be transferred from the I/O circuitry directly to the core logic supply lines. A problem exists, however, in that the multiple number of series diodes that provide ESD protection may not allow a core operating voltage that is sufficient to properly initialize the core logic of the chip.

U.S. Pat. No. 5,625,280 teaches the use of an on-chip voltage regulator circuit to bypass ESD events in a multi-voltage environment. This solution, however, does not address the problem of how to properly initialize the various logic components of the chip that operate at different voltage power supply levels.

Although latch-up condition is one problem associated with multi-voltage integrated circuits, other problems resulting from carrier injection may also cause a reduction in reliability of the integrated circuit; particularly at power-up. To combat problems of carrier injection in a multi-voltage integrated circuit, U.S. Pat. No. 5,920,089 discloses carefully configured CMOS well and substrate structures.

Thus, a need still exists for a circuit solution to the problem of power-up in a multi-voltage integrated circuit.

SUMMARY OF THE INVENTION

The present invention is a circuit for power-up sequencing of a multi-voltage integrated circuit (i.e., a chip). The chip is fabricated to include a plurality of electrostatic devices coupled between first and second power supply lines. The circuit comprises a node, with a first electrostatic device being coupled between the node and the second power supply line. A switching device is coupled between the first power supply line and the node. Lastly, the invention includes a means for controlling the conductivity of the switching device such that upon power-up the switching device is initially in a high conducting state, and changes to a low conducting state thereafter.

BRIEF DESCRIPTION OF THE DRAWINGS

The present invention will be understood more fully from the detailed which follows and from the accompanying drawings, which however, should not be taken to limit the invention to the specific embodiments shown, but are for explanation and understanding only.

DETAILED DESCRIPTION

Figure 1:
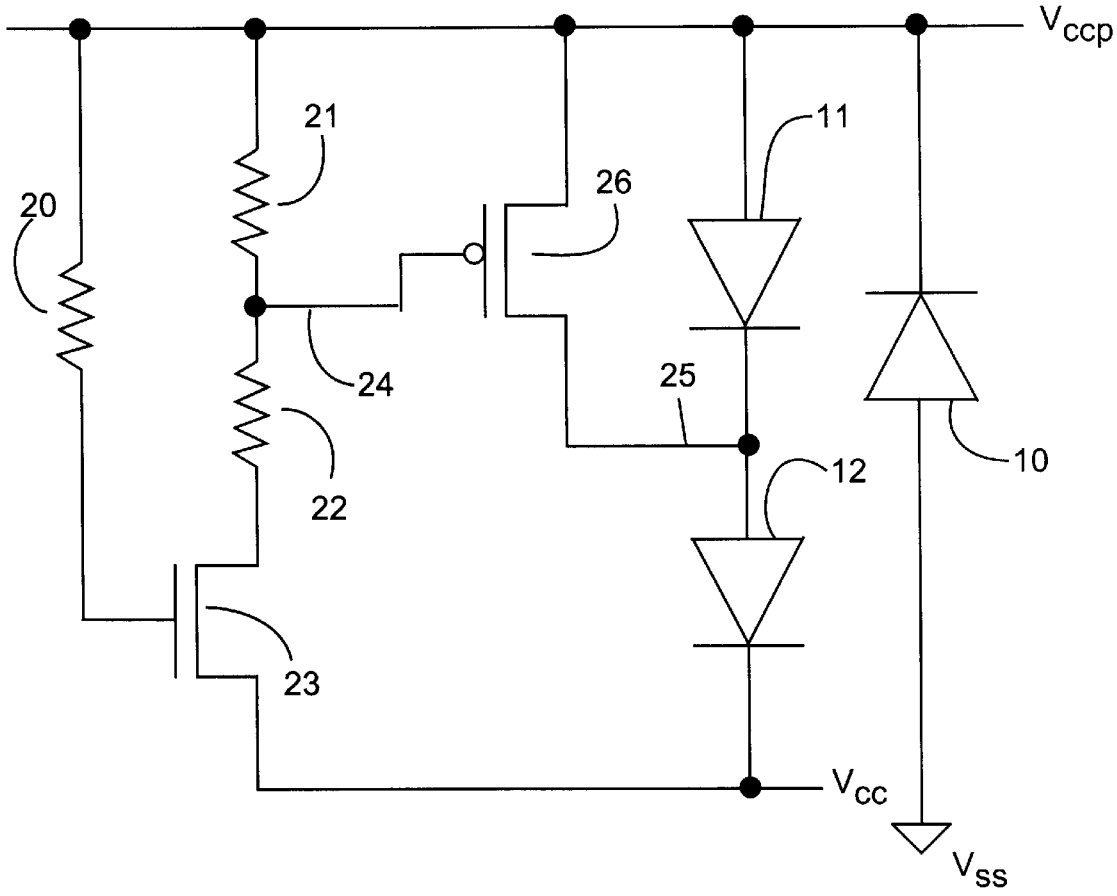
FIG. 1 is a schematic diagram of one embodiment of the power-up circuit of the present invention.

A circuit for power-up sequencing of a multi-voltage semiconductor chip is described. In the following description numerous specific details are set forth, such as specific operating states, potentials, circuit elements, etc., in order to provide a thorough understanding of the present invention. It will be obvious, however, to one skilled in the art, that these specific details may not be needed to practice the present invention.

With reference to FIG. 1 there is shown a circuit schematic diagram of one embodiment of the present invention. Included in the circuit schematic diagram of FIG. 1 are diodes 10–12, which provide protection for ESD events that may occur with respect to the integrated circuit. That is, diodes 10–12 are normally associated with the integrated circuit, independent from the power-up sequencing circuitry of the present invention. They are included in the diagram of FIG. 1 since the power-up sequencing circuitry connects to these diodes.

Diode 10 is connected between reference power supply lines $V_{CCP}$ and $V_{SS}$. In addition, diodes 11 and 12 are connected in series between $V_{CCP}$ and $V_{CC}$. Again, this diode string is for ESD purposes, but it does supply an initialization voltage of $V_{CCP}$ minus two diode drops at power-up. In one embodiment, it is contemplated that $V_{CCP}$ provides an I/O voltage of 3.3 volts, while $V_{CC}$ provides a power supply voltage of 2.5 volts for the core logic of the integrated circuit. An example of an integrated circuit utilizing these voltages may be a memory translator circuit operating with a core voltage of 2.5 volts and an I/O voltage of 3.3 volts for interfacing to static DRAM devices.

Also shown in FIG. 1 is a PMOS field effect device 26 coupled between $V_{CCP}$ and node 25. Node 25 is an intermediate node that connects diodes 11 and 12. The gate of PMOS transistor 26 is shown being coupled to node 24 of a voltage divider network. The voltage divider network comprises resistors 21, 22, and NMOS field-effect device 23, all of which are coupled in series between $V_{CCP}$ and $V_{CC}$. Note that the gate of NMOS transistor 23 is coupled to $V_{CCP}$ through resistor 20.

PMOS transistor 26 and the voltage divider network function to provide a bypass path around diode 11 during power-up. It is this bypass path that allows proper core voltage initialization. Practitioners in the art will appreciate that the circuit of the present invention insures no overvoltage during power-up and is independent of power-up sequencing.

When power is first provided to power supply line $V_{CCP}$ (before $V_{CC}$) field-effect device 23 is turned on with a maximum gate to source voltage $V_{GS}$. With transistor 23 conducting freely, the voltage at node 24 is biased as a simple resistor divider network ($=[R_{22}/(R_{21}+R_{22})]V_{CCP}$) where $R_{on}$ of device 23 is much less than $R_{21}+R_{22}$. Thus, the values of resistors 21 and 22 essentially provide a bias voltage at node 24 that is sufficient to turn on PMOS transistor 26. To put it another way, the voltage divider network provides a $V_{GS}$ to device 26 that is much greater than the threshold voltage $V_{TP}$, of the device.

It should be understood that device 26 is normally sized sufficiently large to supply adequate current from $V_{CCP}$ to node 25 and through diode 12 to $V_{CC}$ during power-up sequencing. In other words, PMOS field-effect device 26 should be large enough to keep node 25 at approximately $V_{CCP}$ as power is transferred from power supply line $V_{CCP}$ to supply line $V_{CC}$. As a result, with device 26 turned on, $V_{CC}$ lags $V_{CCP}$ by approximately one diode drop (i.e., diode 12). This permits the core logic of the integrated circuit to initialize with a relatively low $V_{CCP}$ voltage.

When supply line $V_{CC}$ and $V_{CCP}$ reach normal operating voltages, e.g., 2.5 volts and 3.3. volts, respectively, then NMOS field-effect device 23 operates in the linear region with reduced $V_{GS}$. At this point, transistor 23 operates more like a resistor rather than a freely conducting transistor. The effect of operating transistor 23 in the linear region is that node 24 is biased to a higher voltage ($=[(R_{22}+R_{on}N_{23})/(R_{on}N_{23}+R_{21}+R_{22})]V_{CCP}$). The higher bias voltage at node 24 causes transistor 26 to operate in the sub-threshold region. In this region, transistor 26 is essentially off, and power supply line $V_{CC}$ is now isolated from $V_{CCP}$ by the two ESD diodes 11 and 12.

To summarize, the circuit of the present invention provides a bypass current path around at least one of the series connected ESD diodes during power-up sequencing such that $V_{CC}$ lags $V_{CCP}$ by approximately one diode drop. As the core voltage rises to initialize the core logic, the bypass path gets shunted, or turned off, to establish the normal integrated circuit ESD protection wherein $V_{CC}$ is isolated from $V_{CCP}$ by two or more ESD diodes. In the illustrated embodiment, device 26 essentially acts as a control switch, with a voltage divider network providing a bias voltage to control the operation of the switch.

Of course, numerous alternative circuit configurations can be utilized to achieve the same functionality. For instance, instead of a voltage divider network, a time delay network may be utilized in conjunction with another type of switching device to provide a bypass path around the one or more ESD diodes connected between the two power supply rails. In other embodiments, more than two diodes may be connected in series between the voltage supply rails. The important point is that power is transferred from $V_{CCP}$ to $V_{CC}$ such that the core voltage is properly initialized and no over-voltage condition occurs during power-up.

We claim:

1. A circuit for power-up of a multi-voltage chip having a plurality of diodes coupled between first and second power supply lines, the circuit comprising:

a first node, a first one of the diodes being coupled between the first node and the second power supply line;

a first resistor coupled between the first power supply line and a second node;

a second resistor coupled to the second node; and a NMOS device coupled between the second resistor and the second power supply line, the gate of the NMOS device being coupled to the first power supply line;

a switching device coupled between the first power supply line and the first node, wherein upon application of power to the multi-voltage chip the switching device is initially in a high conducting state, and changes to a low conducting state thereafter.

2. The circuit of claim 1 wherein the switching device changes to the low conducting state responsive to an increase in potential of the second power supply line.

3. The circuit of claim 2 wherein a second one of the diodes is coupled between the first power supply line and the first node.

4. The circuit of claim 1 wherein the switching device comprises a transistor.

5. The circuit of claim 1 wherein the switching device comprises a PMOS device.

6. The circuit of claim 1 further comprising a third resistor coupled between the first power supply line and the gate of the NMOS device.

7. A power-up circuit for a multi-voltage chip having two or more diodes coupled in series between first and second power supply lines, the power-up circuit comprising:

a first node, a first one of the diodes being coupled between the first node and the second power supply line;

a first MOS transistor coupled between the first power supply line and the first node, the gate of the first MOS transistor being coupled to a second node; and a first resistor coupled between the first power supply line and the second node;

a second resistor coupled to the second node;

a second MOS transistor coupled between the second resistor and the second power supply line, the gate of the second MOS transistor being coupled to the first power supply line; and wherein the second node rises in potential following application of power to the multi-voltage chip, thereby regulating the conductivity of the first MOS transistor.

8. The power-up circuit of claim 7 wherein the first MOS transistor changes from a high conducting state to a low conducting state responsive to an increase in potential of the second power supply line following application of power to the multi-voltage chip.

9. The power-up circuit of claim 7 wherein the first MOS transistor comprises a PMOS transistor.

10. The power-up circuit of claim 7 further comprising a third resistor coupled between the first power supply line and the gate of the second MOS transistor.

11. A method for powering-up a multi-voltage chip having first and second supply lines comprising:

providing power to the first supply line;

transferring power from the first supply line to the second supply line through a path that includes a switching device and an electrostatic protection device; and decreasing the conductivity of the switching device as the switching device as the second supply line rises in potential.

12. The method according to claim 11 wherein the conductivity of the switching device is decreased until the switching device is substantially off.

13. The method according to claim 11 wherein the electrostatic protection device comprises a diode having an anode coupled to the switching device and a cathode coupled to the second supply line.

14. The method according to claim 11 wherein the switching device comprises a PMOS device.

* * * * *